US008926416B2

(12) United States Patent
Nicora

(10) Patent No.: US 8,926,416 B2
(45) **Date of Patent: *Jan. 6, 2015**

(54) SPORTS SIMULATOR AND SIMULATION METHOD

(75) Inventor: Daniel Nicora, Temecula, CA (US)

(73) Assignee: Full Swing Golf, San Diego, CA (US)

( * ) Notice: Subject to any disclaimer, the term of this patent is extended or adjusted under 35 U.S.C. 154(b) by 1141 days.

This patent is subject to a terminal disclaimer.

(21) Appl. No.: 11/837,289

(22) Filed: Aug. 10, 2007

(65) Prior Publication Data

US 2009/0042627 A1 Feb. 12, 2009

(51) Int. Cl.

| | |
|---|---|
| ***A63F 9/00*** | (2006.01) |
| ***A63B 69/36*** | (2006.01) |
| ***A63B 24/00*** | (2006.01) |
| *A63B 69/00* | (2006.01) |

(52) U.S. Cl.

CPC ..... *A63B 69/3658* (2013.01); *A63B 24/0003* (2013.01); *A63B 24/0021* (2013.01); *A63B 69/0002* (2013.01); *A63B 69/002* (2013.01); *A63B 2024/0031* (2013.01); *A63B 2207/02* (2013.01); *A63B 2220/05* (2013.01); *A63B 2220/35* (2013.01); *A63B 2220/803* (2013.01); *A63B 2220/807* (2013.01); *A63B 2220/808* (2013.01)

USPC ..... 463/2

(58) Field of Classification Search

USPC ..... 463/2

See application file for complete search history.

(56) References Cited

U.S. PATENT DOCUMENTS

| | | | | | |
|---|---|---|---|---|---|
| 4,150,825 | A | * | 4/1979 | Wilson | 473/152 |
| 4,160,942 | A | * | 7/1979 | Lynch et al. | 359/443 |
| 4,542,906 | A | * | 9/1985 | Takase et al. | 473/152 |
| 4,563,005 | A | * | 1/1986 | Hand et al. | 473/455 |
| 5,056,791 | A | * | 10/1991 | Poillon et al. | 473/156 |
| 5,221,082 | A | * | 6/1993 | Curshod | 473/199 |
| 5,333,874 | A | * | 8/1994 | Arnold et al. | 473/156 |
| 5,342,054 | A | * | 8/1994 | Chang et al. | 473/156 |
| 5,443,260 | A | * | 8/1995 | Stewart et al. | 473/451 |
| 5,478,077 | A | * | 12/1995 | Miyahara | 473/154 |
| 5,566,951 | A | * | 10/1996 | Dart et al. | 273/358 |
| 5,649,706 | A | * | 7/1997 | Treat et al. | 273/358 |
| 5,768,151 | A | * | 6/1998 | Lowy et al. | 463/2 |
| 5,846,139 | A | * | 12/1998 | Bair et al. | 473/156 |
| 5,882,204 | A | * | 3/1999 | Iannazo et al. | 434/251 |

(Continued)

FOREIGN PATENT DOCUMENTS

| | | |
|---|---|---|
| JP | 08-182786 | 7/1996 |
| JP | 2004135706 | 5/2004 |

(Continued)

OTHER PUBLICATIONS

Dead Solid Golf, Golf Simulator Swing Analysis, http://golfindoor.com/golf_simulators_swing_analysis.html (last visited Aug. 25, 2008).

(Continued)

*Primary Examiner* — Seng H Lim

(74) *Attorney, Agent, or Firm* — Knobbe Martens Olson & Bear LLP

(57) ABSTRACT

A sports simulator calculates spin of a sports object using image analysis. A velocity vector is also calculated. These are combined to produce a predicted future trajectory of the sports object. In one embodiment, the sports object is a golf ball and the sports simulator simulates golf.

9 Claims, 6 Drawing Sheets

(56) References Cited

U.S. PATENT DOCUMENTS

| | | | | |
|---|---|---|---|---|
| 5,906,547 | A * | 5/1999 | Tynan | 473/199 |
| 5,926,780 | A * | 7/1999 | Fox et al. | 702/142 |
| 6,012,987 | A * | 1/2000 | Nation | 473/156 |
| 6,042,483 | A * | 3/2000 | Katayama | 473/199 |
| 6,286,364 | B1 * | 9/2001 | Aoyama et al. | 73/65.03 |
| 6,458,035 | B1 * | 10/2002 | Katayama | 473/199 |
| 6,571,600 | B2 * | 6/2003 | Bissonnette et al. | 73/12.02 |
| 6,700,486 | B1 * | 3/2004 | Banki | 340/541 |
| 6,834,129 | B2 * | 12/2004 | Asakura | 382/289 |
| 7,038,764 | B2 * | 5/2006 | Lee | 356/28 |
| 7,098,891 | B1 * | 8/2006 | Pryor | 345/158 |
| 7,300,356 | B2 * | 11/2007 | Nishino et al. | 473/131 |
| 7,324,663 | B2 | 1/2008 | Kiraly | |
| 7,544,137 | B2 * | 6/2009 | Richardson | 473/415 |
| 7,946,960 | B2 * | 5/2011 | Vitolo et al. | 482/8 |
| 7,959,517 | B2 * | 6/2011 | Lastowka | 473/198 |
| 8,016,688 | B2 * | 9/2011 | Gobush | 473/131 |
| 2004/0030527 | A1 | 2/2004 | Rankin | |
| 2004/0125115 | A1 * | 7/2004 | Takeshima et al. | 345/634 |
| 2004/0242292 | A1 * | 12/2004 | Hansen | 463/1 |
| 2004/0248662 | A1 * | 12/2004 | Gobush et al. | 473/199 |
| 2005/0023763 | A1 * | 2/2005 | Richardson | 273/348 |
| 2005/0159231 | A1 * | 7/2005 | Gobush | 473/131 |
| 2005/0239548 | A1 * | 10/2005 | Ueshima et al. | 463/36 |
| 2006/0046861 | A1 * | 3/2006 | Lastowka | 473/151 |
| 2006/0063574 | A1 * | 3/2006 | Richardson et al. | 463/1 |
| 2006/0082657 | A1 * | 4/2006 | Meier | 348/208.7 |
| 2006/0281572 | A1 | 12/2006 | Gobush et al. | |
| 2007/0060410 | A1 * | 3/2007 | Gobush | 473/140 |
| 2007/0196800 | A1 | 8/2007 | Douthit et al. | |
| 2007/0238539 | A1 * | 10/2007 | Dawe et al. | 473/131 |

FOREIGN PATENT DOCUMENTS

| | | |
|---|---|---|
| JP | 2007038000 | 2/2007 |
| KR | 1020030044601 | 6/2003 |
| WO | WO 2007/146620 A | 12/2007 |

OTHER PUBLICATIONS

Golf Simulator brochure, http://www.trugolf.com.

Holiday Golf Simulators brochure, http://www.holidaygolfusa.com/HolidayGolfBrochure2008.pdf.

Indoor Golf Simulators by AboutGold, http://www.aboutgolf.com/3trak.html (last visited Aug. 25, 2008).

Par T Golf, Advanced Indoor Golf Simulators, http://www.partgolf.com/DE_Tech.htm (last visited Aug. 25, 2008).

Brox et al. Three-dimensional shape knowledge for joint image segmentation and pose estimation. In Pattern Recognition, Vienna, Austria, pp. 109-116, Aug. 2005.

Els, DNJ. The Hassenpflug matrix tensor notation. Department of Mechanical Engineering, University of Stellenbosch, South Africa, pp. 1-11, 2001.

Shum et al. Tracking the translational and rotational movement of the ball using high-speed camera movies. City University of Hong Kong, 4 pages.

Tamaki et al. Measuring ball spin by image registration. Niigata University, Japan, 6 pages.

U.S. Final Office Action for U.S. Appl. No. 12/688,659, dated Oct. 9, 2012.

U.S. Non-final Office Action for U.S. Appl. No. 12/688,659, dated Nov. 21, 2011.

Amendment and Response to U.S. Office Action dated Nov. 21, 2011; Filed on May 16, 2012.

* cited by examiner

SPORTS SIMULATOR AND SIMULATION METHOD

BACKGROUND OF THE INVENTION

1. Field of the Invention

The present invention relates generally to computer based sports simulators, and more particularly to systems for predicting the future trajectory of a sports object. In particular, the invention relates to a golf simulator.

2. Description of the Related Art

Golf is a sport that is continuing to grow in popularity. One of golf's main attractions to enthusiasts is the continual challenge of improving one's game. To become an adept golfer and to maintain golfing proficiency, a significant amount of practice is required. However, few enthusiasts have the available time required to play full rounds of golf or to practice hitting golf balls at outdoor driving ranges. To solve this problem, many have found indoor golf simulators to be a viable alternative.

Golf simulators have been introduced for providing an indoor facility in which a golfer can practice all aspects of the golfing game. One example of such a device is disclosed in U.S. Pat. No. 5,333,874 to Arnold et al., which is incorporated herein by reference. According to the Arnold invention, a golfer can hit a golf ball against a screen, and an image of a golf course that is projected onto the screen displays the projected path of the golf ball. Prior to hitting the screen, the golf ball travels through two arrays that capture the golf ball's position to calculate the translational velocity of the golf ball. After hitting the screen, the golf ball bounces back through the second array. The position of the golf ball on its rebound is compared to its position when it first passed through the second array. This measurement is then used to calculate the rotational velocity of the golf ball.

One drawback of the Arnold invention is in its limited precision when measuring the rotational velocity. The rotational velocity, or spin, of the golf ball is a major component in determining a precise trajectory of the golf ball as well as its movement after hitting the ground. Allowing a more precise measurement of the spin of the golf ball will help improve a golfer's game by giving them more realistic results when displaying the golf ball's predicted future trajectory.

SUMMARY OF THE INVENTION

In one embodiment, the invention comprises a method for simulating a sports activity. The method includes accelerating a sports object from a launch area towards a screen, capturing images of the sports object, and determining, based at least in part on the images, one or more components of rotational velocity of the sports object. The method further includes determining translational velocity of the sports object, computing a future trajectory of the sports object based at least in part on the one or more components of rotational velocity and the translational velocity, and displaying the future trajectory of the sports object.

In another embodiment, an apparatus for simulating a sports activity where the future trajectory of a sports object is predicted is provided. The apparatus includes strobe lights, a strobe controller coupled to the strobe lights, a triggering device coupled to the strobe controller to flash the strobe lights, at least one camera that captures images viewed by the strobe lights, a computer that takes the captured images and computes the spin and trajectory of the sports object, and a display that shows the predicted trajectory of the sports object.

DETAILED DESCRIPTION OF THE PREFERRED EMBODIMENT

Figure 1:
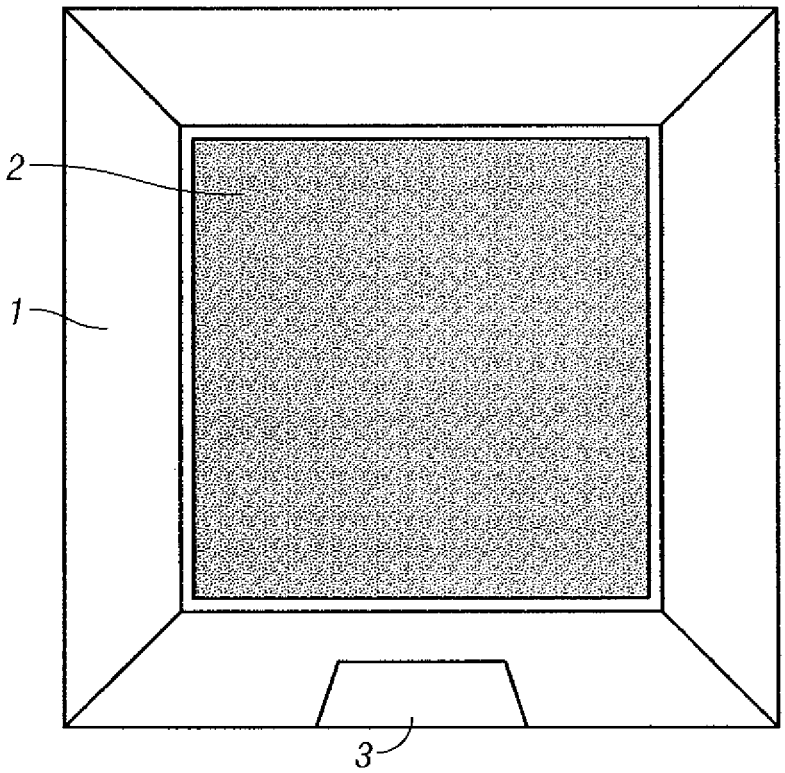
FIG. 1 is a perspective view of a generic sports simulator.

Aspects of the invention will now be described with reference to the Figures. Referring first to FIG. 1, a sports simulator is illustrated. Common characteristics of a sports simulator include a simulator enclosure 1, a display 2, and a launch area 3 where a sports object would normally be accelerated towards the display 2. In some embodiments, no actual enclosure 1 is provided, and the launch area 3 and screen 2 are set up in a room or even outdoors.

The sports object will typically comprise a ball of some kind, and the display 2 will have an image thereon that is appropriate for the sport being simulated. For example, a baseball could be thrown from the launch area 3 to an image of a catcher on the display 2. A soccer ball could be kicked toward an image of a goal. In the exemplary embodiment described herein, the sports object is a golf ball and the display on the screen is a fairway, green, or other part of a golf course. In these embodiments, after the golf ball hits the display, an image of the ball following a predicted trajectory is generated and displayed to simulate a golf shot in the displayed golf course. Although golf simulation is a particularly advantageous application of the inventions described herein it will be appreciated that other sports simulation could be performed in accordance with the principles described.

As mentioned above, displaying an image of the golf ball trajectory on the display screen in an accurate manner requires an evaluation of the spin imparted to the object by the golf club at impact. The spin determines hook and slice, bite on impact, etc. It is one aspect of some embodiments of the invention that the spin is determined with image processing techniques as set forth further below.

Figure 2:
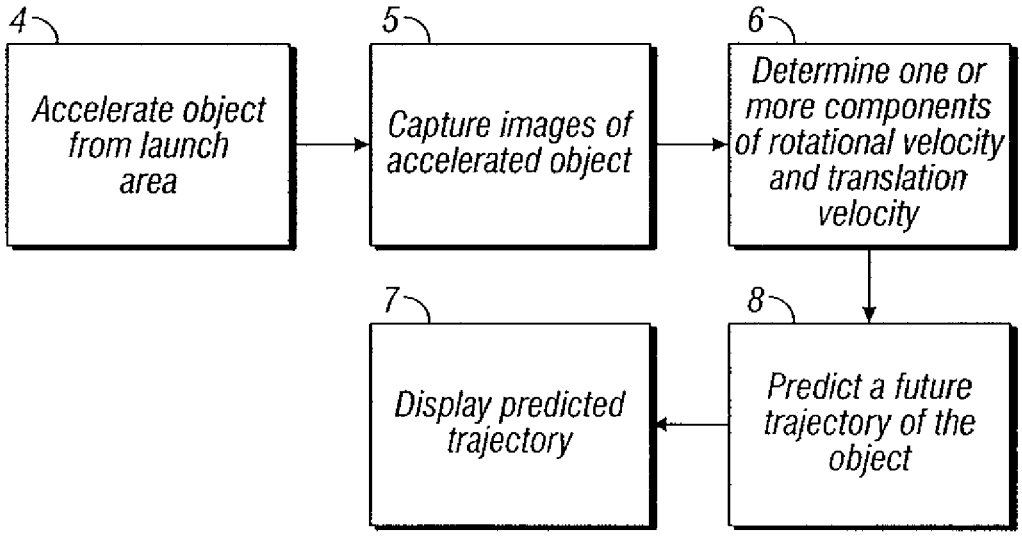
FIG. 2 is a block diagram showing the method for simulating a sports activity.

Referring now to FIG. 2, a block diagram is shown illustrating one method according to this aspect of the invention for simulating a sports activity. The simulation begins at block 4 with the acceleration of a sports object from the launch area. Once the object is in motion, multiple images of the object are captured at block 5. Next, components of rotational and translational velocities 6 of the object are calculated as the object travels towards the display 2. With the velocities calculated, a prediction of the future trajectory 7 is ascertained and then displayed 8 on the screen 2.

Figure 3:
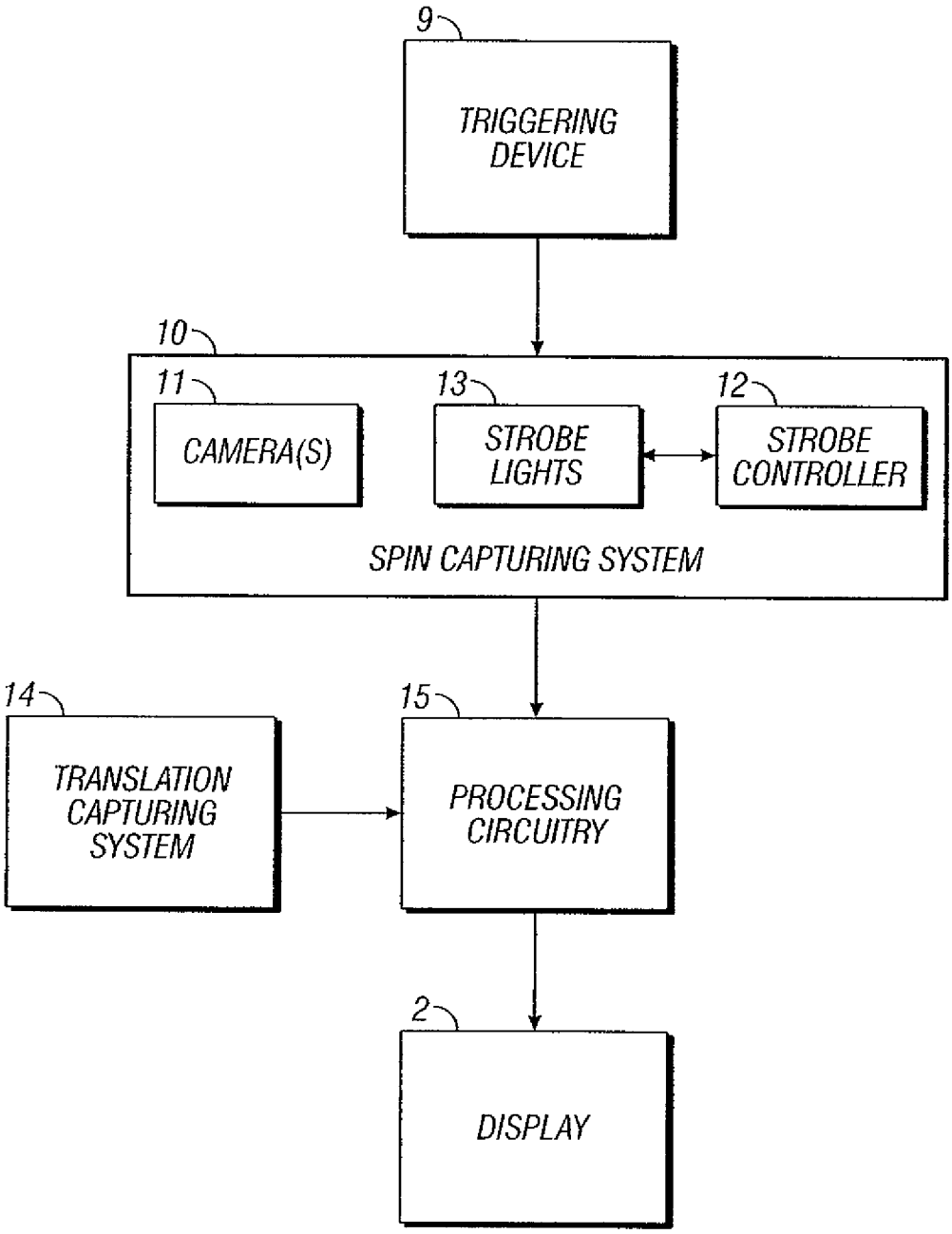
FIG. 3 is a block diagram showing the configuration of the apparatus for simulating a sports activity.

In FIG. 3, an apparatus for simulating a sports activity that may be used to implement the method of FIG. 2 is shown as a block diagram. In this embodiment, the triggering device 9 begins the operation of the simulator. The triggering device 9 may comprise a motion detector, a microphone, or a combination of both. Its function is to detect when an object is struck in the launch area 3 and trigger the operation of the spin capturing system 10. The spin capturing system 10 is comprised of a single or multiple cameras 11 and a lighting system. The lighting system in this embodiment is comprised of a strobe controller 12 coupled to one or more strobe lights 13. The lighting system is preferably sufficient to evenly illuminate the field of view of the object so the field of view has similar contrast. Greater light intensity will generally be used the further the spin capturing system 10 is away from the object.

Once the spin capturing system 10 has acquired images of the object, the object may pass through a translational velocity capturing system 14 which secures translational velocity components of the object as it travels towards the screen 2.

Processing circuitry 15 is configured to compute components of rotational velocity based at least in part on the images captured by the spin capturing system 14. The processing circuitry 15 also computes the translational velocity of the object and then combines it with the computed rotational velocity to compute a future trajectory of the object. When the object reaches the display 2, the future trajectory has been computed and is then displayed on the screen 2.

The images acquired by the camera 11 are processed to produce a measure of the change in angular orientation of the sports object between two or more images. Knowing the time span between strobes, a rotational velocity can be derived. Thus, using multiple strobes on a systematic inter-strobe time period can capture at least two clean images of the object to analyze.

Generally, the first step of image analysis is to define the pixels in the one or more images that correspond to the sports object. This may be done by an edge detection method such as by binarizing the image and detecting the binary large objects (blobs). The blobs can be found by labeling each color characteristic of the object pixel that is connected to another. The appropriately shaped blobs represent the object whereas the other blobs are background artifacts. Another way to perform edge detection is to use the Canny or Sobel methods. Once you find the edges, the image processing algorithm can then pick out the edges for the round shapes which represent the object. Overlapping images of the sports object can be identified by the area and the shape of the blobs, those images can be discarded and used to know which imprint was made by which strobe. This gives a time period between two clean images of the object. Once that is done, the location of the object edges can be refined in order to more accurately pick out the shape and center of gravity of the object.

Once two clean images of the object are identified, the pixel values in each image can be compared to determine how much the object rotated between the two images and around what axes of rotation. Most objects have stamps on the poles and equator as well as identification marks put on the object by the manufactures. These marks move between images, and comparing their change in position allows a spin vector computation to be made. Even without intentionally created markings, sports objects will include texture on the surface that can be used in the image analysis in the same basic way. Although changes in object orientation between images can often be seen easily by eye, it can be complex to analyze automatically. However, methods to compute components of rotational velocity of a variety of objects have been developed using image analysis. Examples of such methods have been described in the articles *Tracking the Translational and Rotational Movements of the Ball using High Speed Camera Movies* by Hubert Shum et al., City University of Hong Kong, and *Measuring Ball Spin by Image Registration* by Toru Tamaki et al., Niigata University. Each of these articles is hereby incorporated by reference in its entirety.

In some such methods, the orientation of the object in each image is defined by Euler angles. The object pixel values of the first image are transformed by different Euler angle changes, and the Euler angle changes that best correlate the pixels of the first image to the pixels of the second image are determined to compute an orientation change between strobes. The Euler angle changes correspond to rotations about three orthogonal axes, which are preferably aligned to the frame of reference of the simulator. Generally, spin around a vertical axis through the center of the ball will define hook and slice. Spin around a horizontal axis through the center of the ball and parallel to the club face will determine top and/or back spin. Spin around a horizontal axis through the center of the ball and approximately normal to the club face will typically be negligible, and the computation can be simplified if spin around this axis is ignored. The spin vector may in these embodiments lie in the vertical plane that is approximately parallel to the club face.

Figure 4:
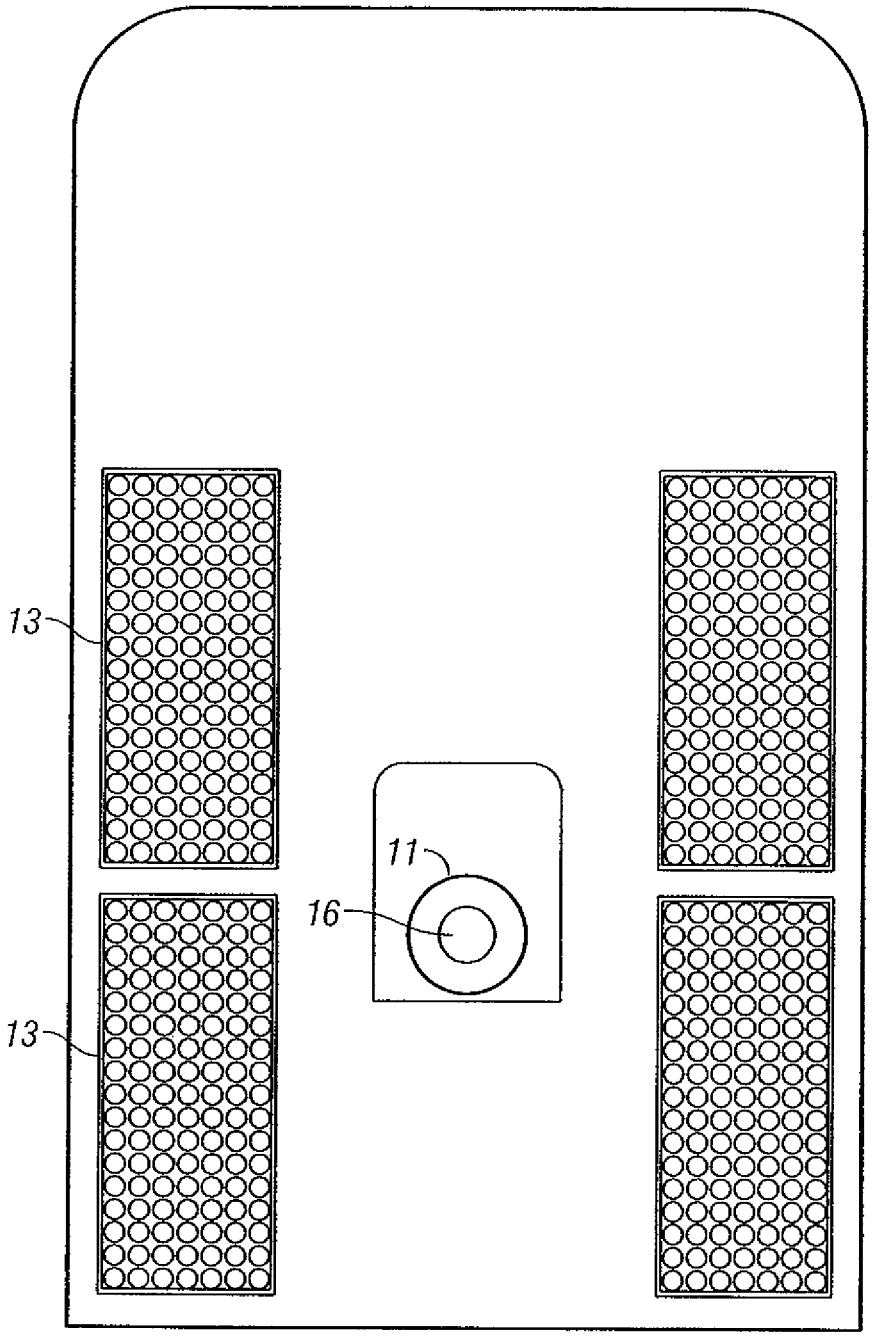
FIG. 4 is a perspective view of the spin capturing system.
Figure 5:
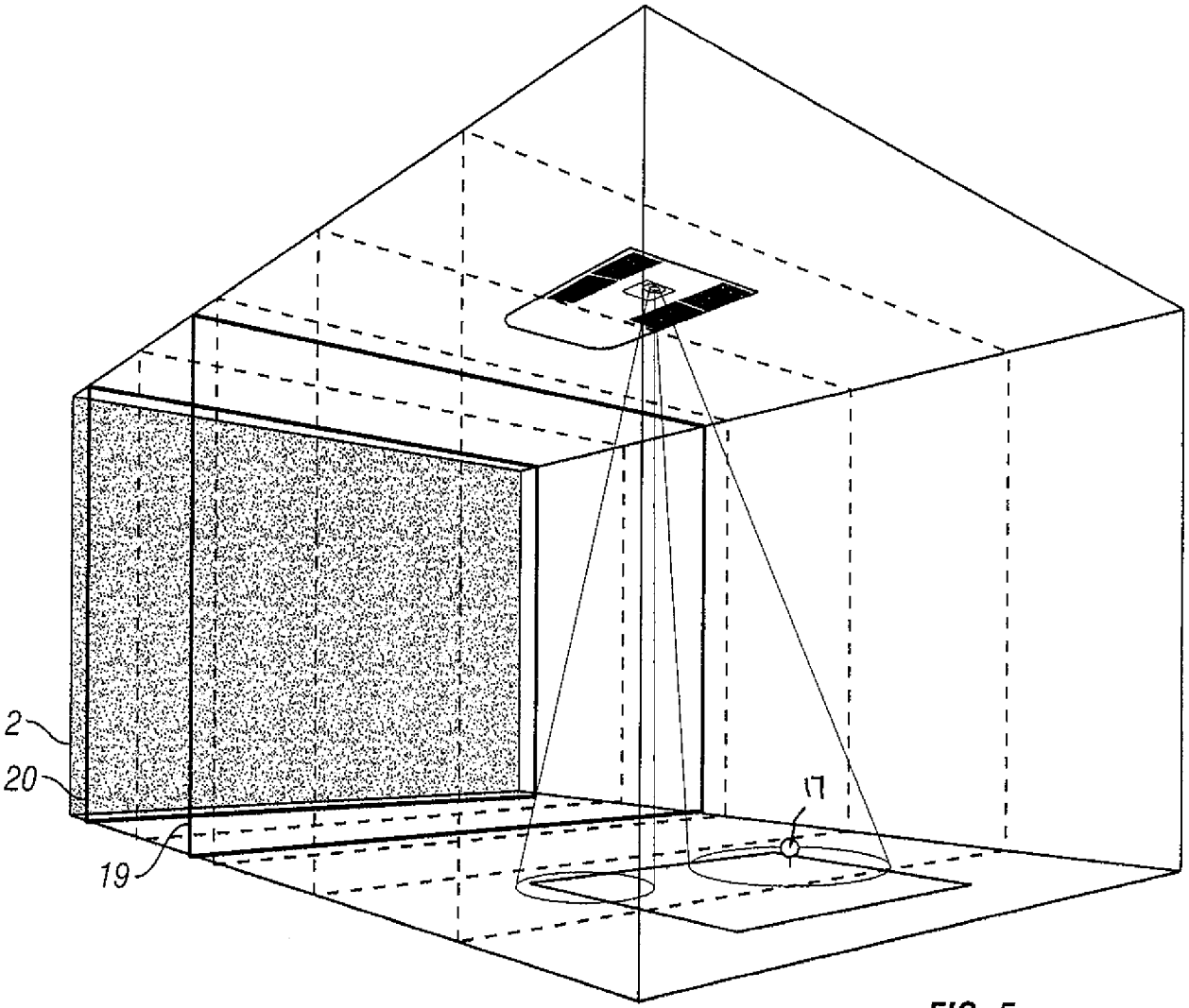
FIG. 5 is a perspective view of the golf simulator system of the present invention.

Referring now to FIGS. 4 and 5, one embodiment of a spin capturing strobe system 10 is shown in detail in FIG. 4 and as part of a golf simulator in FIG. 5. Strobe lights 13 may be placed along the side a camera 11 to illuminate and acquire images of the golf ball as it leaves the tee. To minimize the disturbance of flashing strobes lights on the player hitting the golf ball, the strobe lights 13 are advantageously configured to emit infrared light and the camera 11 may be a CCD and/or a CMOS camera configured to be sensitive to infrared light. To reduce noise from visible light sources, an infrared filter 16 may be coupled to the lens of the camera 11.

Now referring to FIG. 5, a golfer may stand in the launch area 3 of the simulator and can drive, pitch, or putt a golf ball 17 towards the screen 2. The screen 2 is of a suitable material and surface to project a video image upon. The image will be projected on the screen using a projector mounted in an area away from possible flight paths of the golf ball.

Figure 6:
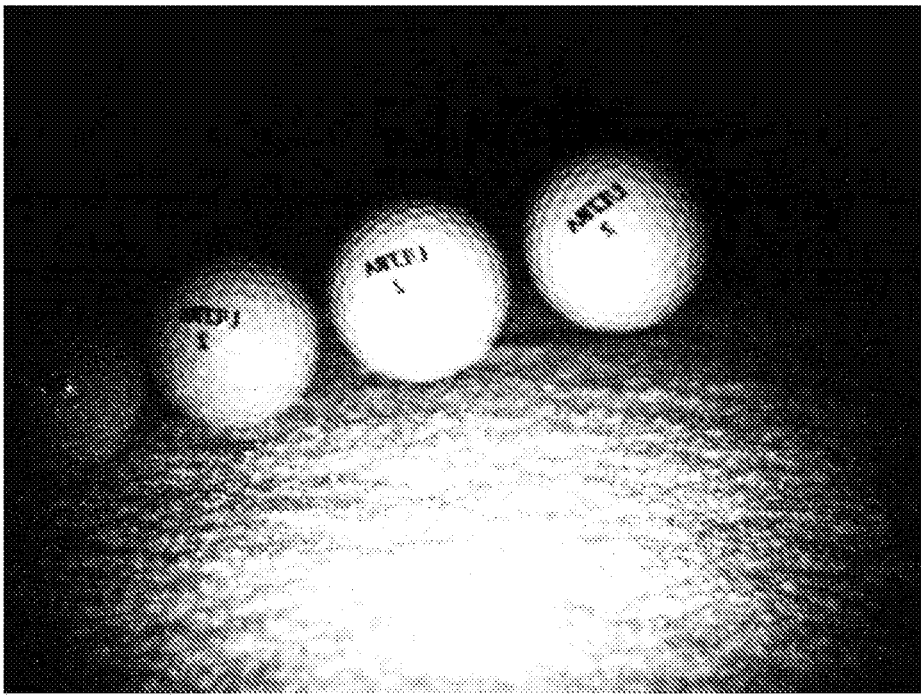
FIG. 6 is an IR strobe image of a golf ball hit off of a tee.

One advantageous placement of the spin capturing system 10 is above the launch area 3 so the camera axis is approximately normal to the ground or floor. In these embodiments, the top or back spin as well as spin defining hook and slice are easily visible. Furthermore, it has been found that advantageous shadows can be produced which enhance the edge detection process during image analysis. However, it will be appreciated that the spin capturing system may also be placed to the side of the launch area so the camera axis is at or near parallel to the ground. Other embodiments may have cameras mounted on poles which are not oriented parallel or normal to the ground, although this makes the image analysis a bit more complex. FIG. 6 shows golf ball images captured under infrared illumination. In these images, the changing position of the logo can be seen visually, and may be used in automated image analysis to compute a spin vector as set forth above.

As illustrated in FIG. 5, the camera can be adjusted for different tee placements for right and left handed players. In general, because the ball can be struck at a variety of locations on the launch area, the camera axis will be tilted slightly to point to the ball prior to club impact and will often be only approximately rather than exactly vertical. In order to allow accurate calculations of the velocity and spin of an object, the spatial location and orientation of the camera 11 relative to the golf ball are determined. This may be achieved by mounting an inclinometer on the camera to determine the direction of the optical axis of the camera. Integrated circuit inclinometers are commercially available and can be used for this purpose.

The spatial location of the camera 11 can be found by taking an image of an object from a known location, and based on the size of the object, the location of the camera 11 can be found and stored for use in the calculations of an object's spin.

Once the ball has left the launch area and the images used to compute spin have been captured, the ball will travel through a first plane 19 and second plane 20 that function as the translational capturing system 14. These planes may include one or more IR beam sensors that determine when and where within each plane the plane the golf ball passes through. This configuration is one method that has been employed to calculate translational velocity, but other methods may also be used. One such embodiment is described in the Arnold patent mentioned above. Because the IR camera used to calculate spin takes 2-D images, it is difficult to produce a 3-D velocity vector from the images taken of the ball off the tee. Thus, it is advantageous to have separate spin and velocity vector acquisition systems. It would, however, be possible to have multiple orthogonally mounted cameras produce both spin and velocity vectors from image analysis.

A computer houses the processing circuitry 15 and controls the simulation. From the computer, a player can also select various options of game play which may include practice modes and golf course selection. Other configuration settings such as trigger timings, delays, and microphone sensitivity may also be controlled from the computer.

Figure 7:
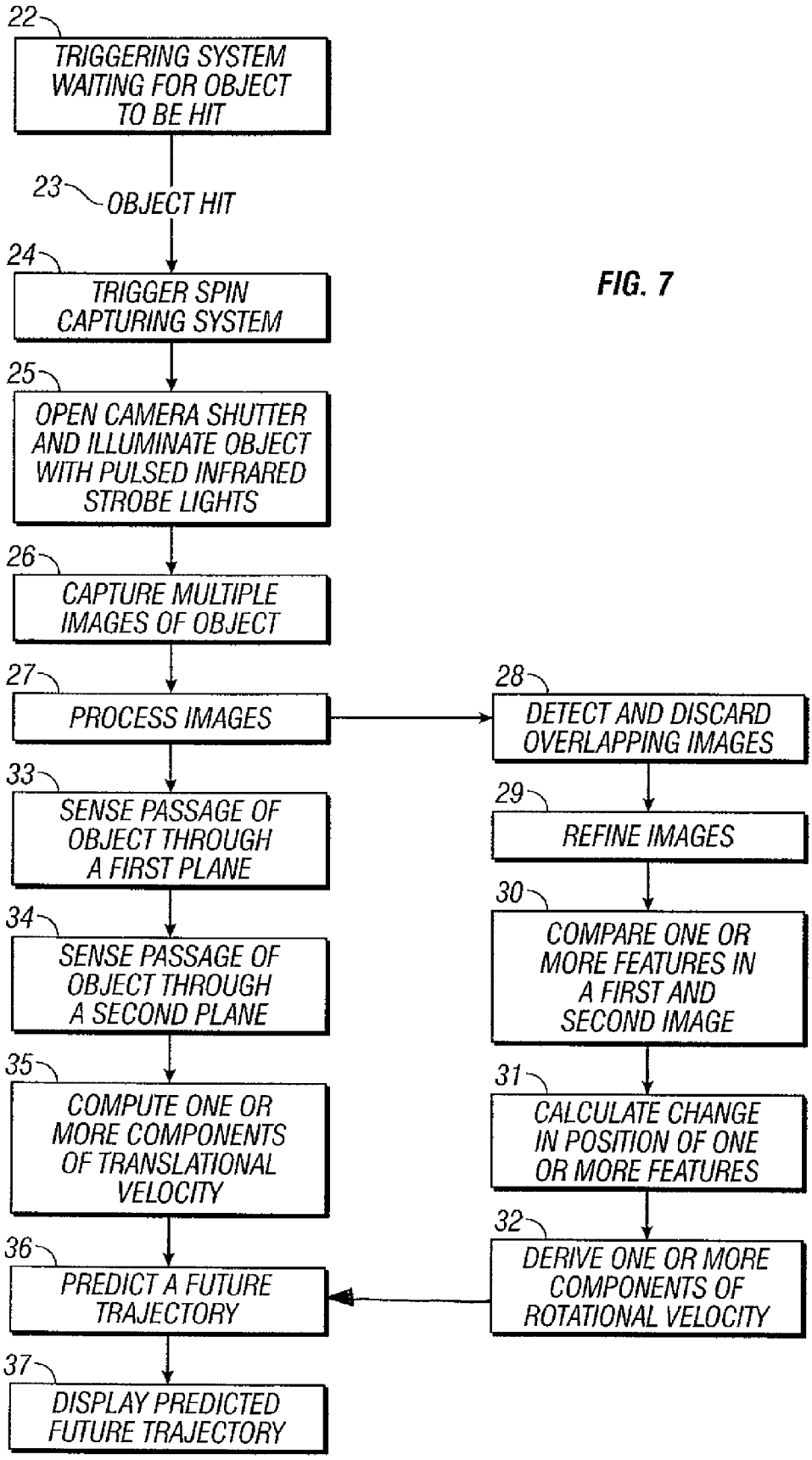
FIG. 7 is a block diagram showing a detailed method for predicting and displaying a future trajectory of an object in a sports simulator.

Referring now to FIG. 7, a block diagram showing a detailed method for predicting and displaying a future trajectory of an object in the sports simulator is shown, The starting point begins with the triggering system waiting for the object to be hit 22. Once the object is hit 23, the spin capturing system is triggered 24. The triggering system opens the camera shutter and illuminates the object with pulsed infrared strobe lights 25. The delay between the opening of the camera shutter and the firing of the strobe lights 13 should be variable so other images, e.g. the face of a golf club, will not interfere with the images of the object. Therefore, the exposure time may also be variable. The camera shutter is then closed resulting in multiple images of the object captured on a single frame 26. The timing of this overall sequence should be flexible to allow for capturing images when the object is struck at different rates of speed. The captured images are then processed 27 by the processing circuitry 15 as described above.

Once the object has left the launch area 3, the object's position will be sensed when it passes through a first plane 33 and once again when is passes through a second plane 34. The position coordinates will map the translational trajectory of the ball, and the time of travel between the two planes is used to calculate the ball's speed. These elements are then combined and the processing circuitry 15 will compute one or more components of translational velocity 35.

Before the object reaches the screen 2, the processing circuitry 15 will predict a future trajectory of the object 36 using the computed components of rotational and translational velocities. Once the object reaches the screen 2, the future trajectory is already computed and the values are sent to a graphics engine to be displayed 37 on the screen 2 by the projector 18.

Accordingly, the present invention provides a sports simulator which can precisely measure components of spin of a sports object using image analysis. Capturing multiple images of a sports object in motion is used to determine one or more components of rotational velocity. Combining those measurements with the translational velocity will result in more precise predictions of a future trajectory of the sports object.

The foregoing description details certain embodiments of the invention. It will be appreciated, however, that no matter how detailed the foregoing appears in text, the invention may be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated, and it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. An apparatus for simulating a sports activity where the future trajectory of a sports object is predicted, the apparatus comprising:

infrared strobe lights;

a strobe controller coupled to said infrared strobe lights;

a triggering device coupled to said strobe controller to flash said infrared strobe lights;

a camera that captures images viewed by said infrared strobe lights, wherein said images comprise said sports object and are captured by said camera in a single exposure by flashing said infrared strobe lights multiple times during said single exposure;

a display that shows a predicted trajectory of said sports object, wherein said display is located in a launch path for the sports object;

at least one position sensor, separate from the camera and comprising two predetermined planes located between an initial launch position for the sports object and said display, and configured to determine a time and position where the sports object passes through each predetermined plane; and a computer that takes the captured images and computes a spin of said sports object based on edge detection analysis of the images and that takes the determined times and positions and computes a translational velocity of the sports object, wherein the computer further determines a predicted trajectory of the sports object based on the spin and the translational velocity.

2. The apparatus as claimed in claim 1 where said strobe lights emit infrared light and said camera is sensitive to infrared light.

3. The apparatus as claimed in claim 1 where an axis of said camera is approximately normal to the ground above a launch area.

4. The apparatus as claimed in claim 1 further comprising an infrared filter on said camera.

5. The apparatus as claimed in claim 1 where the triggering device opens a shutter on said camera.

6. The apparatus as claimed in claim 1 where the triggering device comprises a microphone.

7. The apparatus as claimed in claim 1 where the triggering device comprises a motion detector.

8. The apparatus as claimed in claim 1 further comprising an inclinometer mounted on said at least one infrared camera.

9. The apparatus as claimed in claim 1, wherein said position sensor comprises an infrared beam sensor.

* * * * *